US006976284B1

(12) United States Patent
Manfredi et al.

(10) Patent No.: US 6,976,284 B1
(45) Date of Patent: Dec. 20, 2005

(54) PAINT ROLLER COVER EXTENDER

(76) Inventors: Peter A. Manfredi, 151 Elmgrove Rd, Rochester, NY (US) 14626; Peter J. Pompeii, 276 Dartmouth St., Rochester, NY (US) 14607

( * ) Notice: Subject to any disclaimer, the term of this patent is extended or adjusted under 35 U.S.C. 154(b) by 319 days.

(21) Appl. No.: 10/392,715

(22) Filed: Mar. 20, 2003

(51) Int. Cl.[7] ..... B05C 17/02
(52) U.S. Cl. ..... 15/230.11; 492/19; 492/47; 492/48
(58) Field of Search ..... 15/230, 230.11; 492/13, 19, 29, 47, 48

(56) References Cited

U.S. PATENT DOCUMENTS

| | | | | | |
|---|---|---|---|---|---|
| 1,994,869 | A * | 3/1935 | Benson | 15/422 |
| 2,538,241 | A * | 1/1951 | Guimond | 15/230.11 |
| 2,708,763 | A * | 5/1955 | Jacoby | 401/194 |
| 2,934,775 | A * | 5/1960 | Bergstrom | 15/106 |
| 3,263,682 | A * | 8/1966 | Rosenfield | 602/63 |
| 3,371,561 | A * | 3/1968 | Fabricant | 81/488 |
| 4,402,102 | A * | 9/1983 | Al-samman | 15/230.11 |
| 4,425,945 | A * | 1/1984 | McDonald | 138/96 T |
| 4,955,515 | A * | 9/1990 | Brull | 223/101 |
| 5,320,531 | A * | 6/1994 | Delizo-Madamba | 433/136 |
| 5,613,264 | A * | 3/1997 | Knowles | 15/230.11 |
| 5,954,245 | A * | 9/1999 | Kluesner | 223/101 |
| 6,185,780 | B1 * | 2/2001 | Napolitan | 15/230.11 |

* cited by examiner

*Primary Examiner*—Mark Spisich

(57) ABSTRACT

The paint roller cover extender is a paint roller cover accessory that would allow the corner areas of a room to be painted in one motion using a conventional paint roller. The product would feature a cylindrical cap having the same diameter as a roller cover, a closed end, and an open end with an elastic band woven into the inner surface near the open edge. The elastic band would allow the unit to be easily snapped over and secured to the end of a roller cover. The paint roller cover extender would be made of the same material as the roller cover. In use, the standard roller cover would be used to apply paint to one section of a corner while the extender would apply paint at a right angle to the other wall of the corner. The paint roller cover extender could be sold as an after purchase accessory for conventional paint roller covers, or it could be packaged as a unit with a paint roller and cover.

9 Claims, 4 Drawing Sheets

PAINT ROLLER COVER EXTENDER

BACKGROUND OF THE INVENTION

1. Field of the Invention

The present invention relates to a painting accessory for use in connection with a paint roller. The paint roller cover extender has particular utility in connection with allowing the user of a paint roller to paint corner areas of a room without using a separate brush.

2. Description of the Prior Art

The conventional method for painting the interior walls of a house is to use a roller-type applicator. A paint roller consists of a handle with a rotatable extension upon which a cylindrical applicator head is placed. The roller head is rotatable about its longitudinal axis and has an outer surface made of a paint retentive material such as lamb's wool. Paint is placed on the surface of the roller head from a paint reservoir and is applied to the desired surface by moving the handle up and down or back and forth, resulting in the roller head moving over the surface and evenly spreading the paint on the surface. For the major portion of the wall, this is an acceptable means for producing an even coating of paint; however, any corners, edges, or raised surfaces present a problem. Typically, the painter spreads paint within a few inches of these areas, lets the paint dry, and then returns at a later time to paint these areas with a paint brush. This technique does not necessarily produce an evenly painted surface. Therefore, a device which allowed the painter to spread paint in the corner area while painting the adjoining wall space would make painting a room easier, less expensive, and less time consuming while producing a smooth, uninterrupted layer of paint.

The use of paint roller accessories is known in the prior art. For example, U.S. Pat. No. 2,959,800 to Edward S. Bischoff discloses a snap on brush for a paint roller that provides a snap on means for attaching a paint brush member to the roller axle. The paint brush member includes the bristles of a paint brush attached to a base which is mounted on the roller axle at the distal end, relative to the handle of the roller. However, use of the Bischoff '800 device to paint corners would not necessarily produce an even layer of paint since some portions would be painted with the roller surface and other portions with the brush member of the device. Additionally, use of the Bischoff '800 device requires the purchase of a specialty roller which internally feeds paint to the roller and brush attachment. If the specialty roller is not used, the apertures in the base of the brush member would allow paint to drip into the internal area of the roller, resulting in messy and time consuming cleanup.

U.S. Pat. No. 6,185,780 B1 to Walter D. Napolitan discloses a corner paint roller that consists of an end cap with a mounting prong projecting perpendicularly from it. The mounting prong engages a space existing between the inner surface of the roller cover and the outer surface of the roller frame barrel so that the possibility of damage to the possibly damp paper tube of the roller cover is avoided when the end cap is installed. However, due to the single point attachment of the Napolitan '780 B1 device to the roller cover, it could possibly come loose or completely detach from the cover, resulting in paint in an unwanted area where the cap falls or a nonuniform application of paint on the wall. Additionally, the painter would have to reposition the cap on the roller, forcing him to stop his task and work with a cap that is covered in paint. Lastly, since the Napolitan '780 B1 device is not securely attached to the roller cover along its edges, paint could seep into the internal portion of the roller. This would lead to a messy and time consuming clean up when the painting task is completed.

Similarly, U.S. Pat. No. 5,613,264 to Curtis N. Knowles discloses a paint roller corner cover which is inserted into the end of the roller. The device uses an annular flange for insertion into the open end of a paint roller with a series of integrally molded, circumferentially spaced lugs protruding from the flange for engagement with the inside of the roller cover. However, the protruding lugs of the Knowles '264 device might tear the inner surface of the paint roller, especially if the end cap is inserted after moisture has accumulated inside the roller cover either from the coating being applied or from a previous cleaning. Furthermore, the thickness of the Knowles '264 device might preclude its use with some pain roller barrels.

U.S. Pat. No. 5,711,047 to John W. Armaly, Jr. discloses a specialty paint roller cover that includes an inner core with two separate core elements over which a cover is attached. The two elements can be twisted to provide a "rag" finish when painting a surface. However, the Armaly, Jr. '047 patent does not address the problem of painting corners with the roller unit. Therefore, any corners or raised areas of the wall would still need to be painted with a brush, resulting in a nonuniform pattern on the wall and increasing the time required to finish the job. Additionally, use of the Armaly, Jr. '047 device requires the purchase of a specialty roller unit, precluding the use of preexisting units and increasing the cost of the project.

Likewise, U.S. Pat. No. 4,257,140 to Stephen B. Downing discloses a painting device that consists of a modified roller cover for producing a textured pattern when painting. The roller cover has raised designs on the surface and can be placed over a conventional roller. However, the Downing '140 device is intended to produce a very specific pattern and would not be useful for conventional paint jobs. Furthermore, the Downing '140 patent does not address the issue of painting the corner areas of a room; therefore, the user would still need to wait for the wall to dry and then paint the corner areas with a brush. This might not result in a uniform pattern in the paint.

U.S. Pat. No. 4,930,179 to Paul B. Wright and Mary V. Ward discloses a decorating tool for a paint roller that provides a broken or "distressed" pattern and consists of a roller cover with attached flexible fabric flaps. However, the Wright, et al. '179 patent makes no provision for painting the corner of the wall with the roller; thus, the corner area of the room would need to be painted with a brush and might not have a matching pattern. Moreover, use of the Wright, et al. '179 device requires the user to wait for the main portion of the wall to dry before painting the corner, increasing the amount of time necessary to paint a surface. Finally the Wright, et al. '179 patent requires the purchase of a specialty roller cover and does not allows the painter to use any preexisting roller covers.

Lastly, U.S. Pat. No. Des. 285,146 to David Abellira discloses the ornamental design for a paint roller cover or similar article that consists of a material formed in a sleeve with a first closed end and a second open end. The sleeve looks as though it can be pulled over the roller. However, the Abellira '146 device is not completely closed on the first end, instead seemingly gathered toward the center of the end. This could lead to paint seeping into the internal area of the roller, resulting in a messy and time consuming clean up when the painting task is completed.

While the above-described devices fulfill their respective, particular objectives and requirements, the aforementioned patents do not describe a paint roller cover extender that allows the user to place a uniformly patterned layer of paint on the entire wall surface of a room without employing a paint brush to paint corners. Use of the Bischoff '800 device to paint corners would not necessarily produce an evenly patterned layer of paint since some portions would be painted with the roller surface and other portions with the brush member of the device. Moreover, the Armaly, Jr. '047, Downing '140, and Wright, et al. '179 patents do not address the problem of painting corners with the roller unit. Therefore, any corners or raised areas of the wall would still need to be painted with a brush, resulting in a nonuniform pattern on the wall. In addition, the time required to finish the job would increase because the paint on the wall would need to dry before the painter could use the brush to finish the corner area. The Bischoff '800, Armaly, Jr. '047, and Wright, et al. '179 patents require the purchase of specialty devices that would preclude the use of preexisting rollers or roller covers and increase the expense of the painting job. Furthermore the Bischoff '800, Napolitan '780 B1, and Abellira '146 devices could allow paint to leak into the internal portion of the roller, leading to a messy and time consuming clean up when the painting task is completed. Additionally, due to the single point attachment of the Napolitan '780 B1 device to the roller cover, it could possibly come loose or completely detach from the cover, resulting in paint in an unwanted area where the cap falls or a nonuniform application of paint on the wall. Should the cap of the Napolitan '780 B1 come loose or detach, the painter would have to reposition the cap on the roller, forcing him to stop his task and work with a cap that is covered in paint. The protruding lugs of the Knowles '264 device might tear the inner surface of the paint roller, especially if the end cap is inserted after moisture has accumulated inside the roller cover either from the coating being applied or from a previous cleaning. Furthermore, the thickness of the Knowles '264 device might preclude its use with some paint roller barrels. Finally, The Downing '140 device is intended to produce a very specific pattern and would not be useful for conventional paint jobs.

Therefore, a need exists for a new and improved paint roller cover extender that can be used for applying a uniform layer of paint to the entire wall surface without employing a paintbrush to apply paint to the corner area. In this regard, the present invention substantially fulfills this need. In this respect, the paint roller cover extender according to the present invention substantially departs from the conventional concepts and designs of the prior art, and in doing so provides an apparatus primarily developed for the purpose of decreasing the amount of time and effort required to paint an entire surface while increasing the uniformity of the paint layer applied.

SUMMARY OF THE INVENTION

In view of the foregoing disadvantages inherent in the known types of paint roller accessories now present in the prior art, the present invention provides an improved paint roller cover extender, and overcomes the above-mentioned disadvantages and drawbacks of the prior art. As such, the general purpose of the present invention, which will be described subsequently in greater detail, is to provide a new and improved paint roller cover extender and method which has all the advantages of the prior art mentioned heretofore and many novel features that result in a paint roller cover extender which is not anticipated, rendered obvious, suggested, or even implied by the prior art, either alone or in any combination thereof.

To attain this, the present invention essentially comprises a cylindrical cap for a paint roller cover that has a closed end, an open end, an elastic band integrated just inside the open end, and is made of the same material as the paint roller cover.

The paint roller cover extender could be sold as an after purchase accessory for a paint roller cover, or it could be packaged as a unit with a paint roller and cover.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved paint roller cover extender that has all of the advantages of the prior art paint roller accessories and none of the disadvantages.

It is another object of the present invention to provide a new and improved paint roller cover extender that may be easily and efficiently manufactured and marketed.

An even further object of the present invention is to provide a new and improved paint roller cover extender that has a low cost of manufacture with regard to both materials and labor, and which accordingly is then susceptible of low prices of sale to the consuming public, thereby making such a paint roller cover extender economically available to the buying public.

Still another object of the present invention is to provide a new paint roller cover extender that provides in the apparatuses and methods of the prior art some of the advantages thereof, while simultaneously overcoming some of the disadvantages normally associated therewith.

Even still another object of the present invention is to provide a paint roller cover extender for allowing corners to be painted in a single motion. This allows the painter to paint a corner while using a paint roller, making the painting task easier by eliminating the need to use a paintbrush for painting a corner and decreasing the amount of time necessary to complete the task.

Yet another object of the present invention is to provide a paint roller cover extender that is easily secured to or removed from a paint roller. This eliminates the tedious process of mounting specialty items to the roller and ensures that the extender will stay in place during the painting task.

Still yet another object of the present invention is to provide a paint roller cover extender that can be seamlessly mounted on a paint roller cover. This allows the painter to place a uniformly patterned layer of paint on the desired surface, especially in the corner areas of a room.

Lastly, it is an object of the present invention to provide a new and improved paint roller cover extender that allows the user to paint corners with a single tool. This saves the painter money since he no longer needs to purchase paintbrushes with which to finish painting the corner areas of a room.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
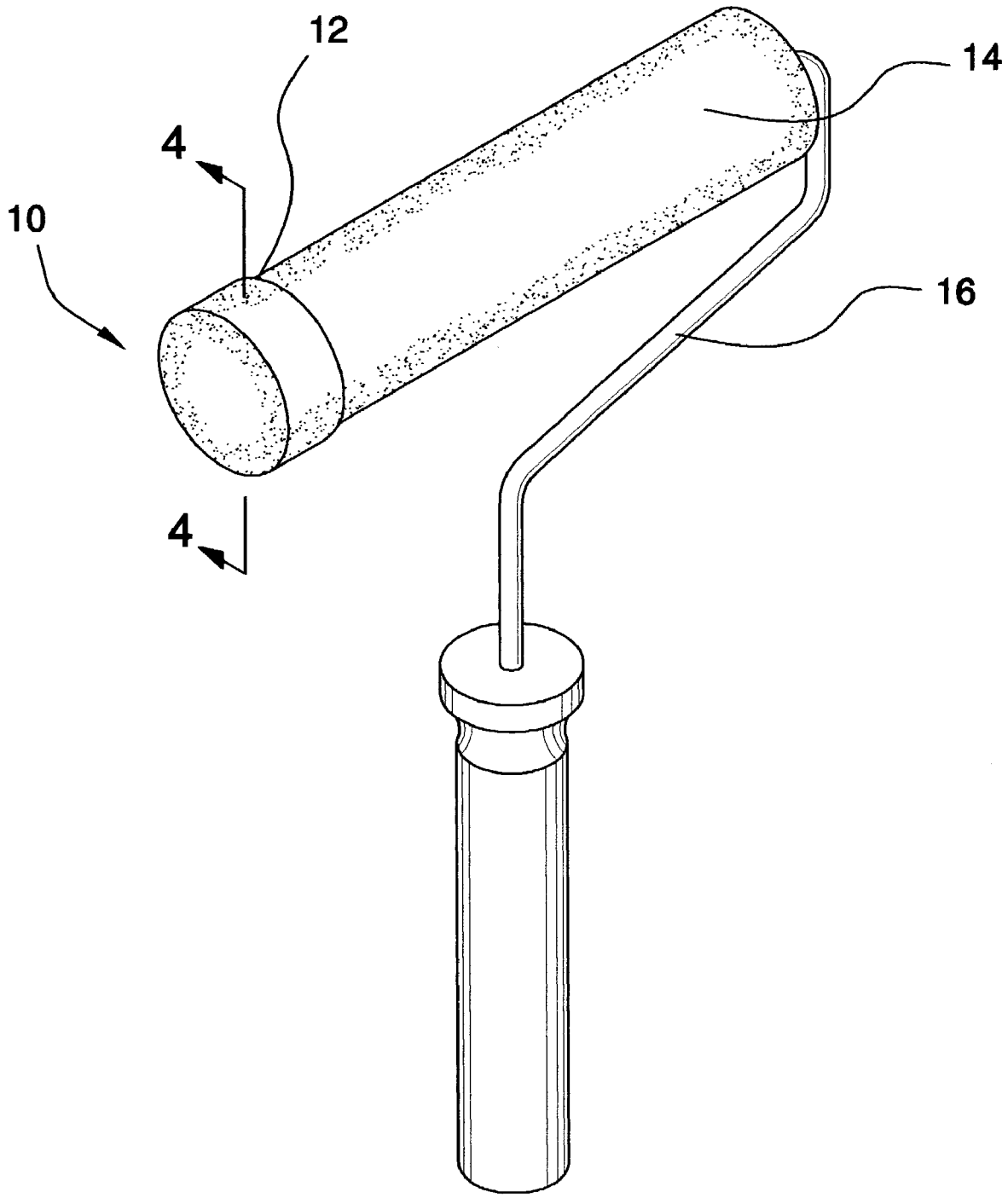
FIG. 1 is a front perspective view of the preferred embodiment of the paint roller cover extender constructed in accordance with the principles of the present invention and mounted on a conventional paint roller.

Referring now to the drawings, and particularly to FIGS. 1–4, a preferred embodiment of the paint roller cover extender of the present invention is shown and generally designated by the reference numeral 10.

In FIG. 1, a new and improved paint roller cover extender 10 of the present invention for allowing the user of a paint roller to paint corner areas of a room without using a separate brush is illustrated and will be described. More particularly, the paint roller cover extender 10 is shown mounted on the distal end 12 of a conventional paint roller cover 14. The paint roller cover 14 is mounted on a standard paint roller 16 which would be used for painting a large surface area, such as a wall.

Figure 2:
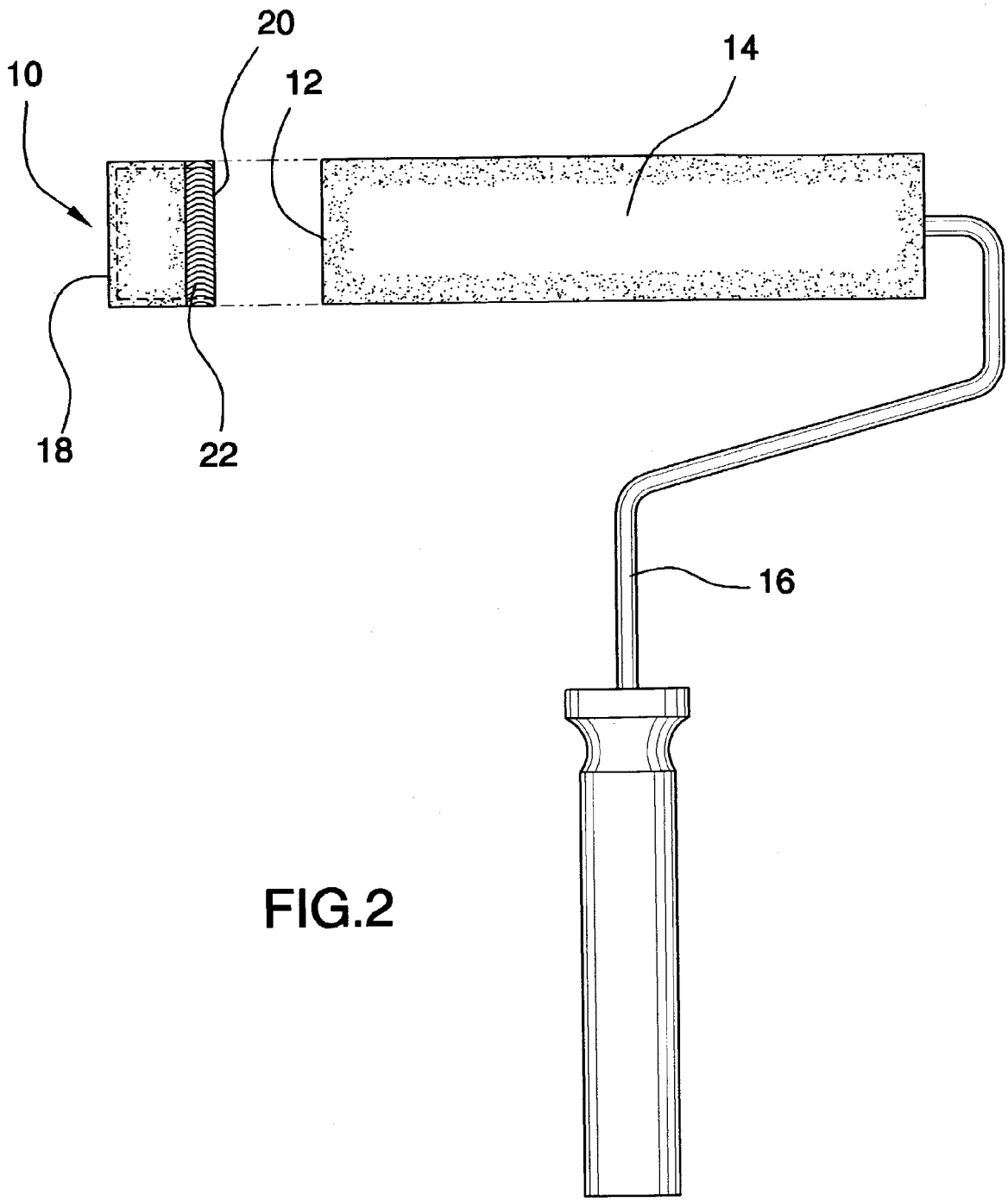
FIG. 2 is a front view of the paint roller cover extender of the present invention.

FIG. 2 shows a front view of the paint roller cover extender 10 when it is removed from the paint roller cover 14. The paint roller cover extender 10 would be made of a nap type material similar to that of a standard paint roller cover 14. It would be cylindrical and hollow with a closed end 18 and an open end 20. The open end 20 would incorporate a band of elastic 22 around its edge for securing the paint roller cover extender 10 over the distal end 12 of the paint roller cover 14. The paint roller cover extender 10 would have approximately the same diameter as a conventional paint roller cover.

Figure 3:
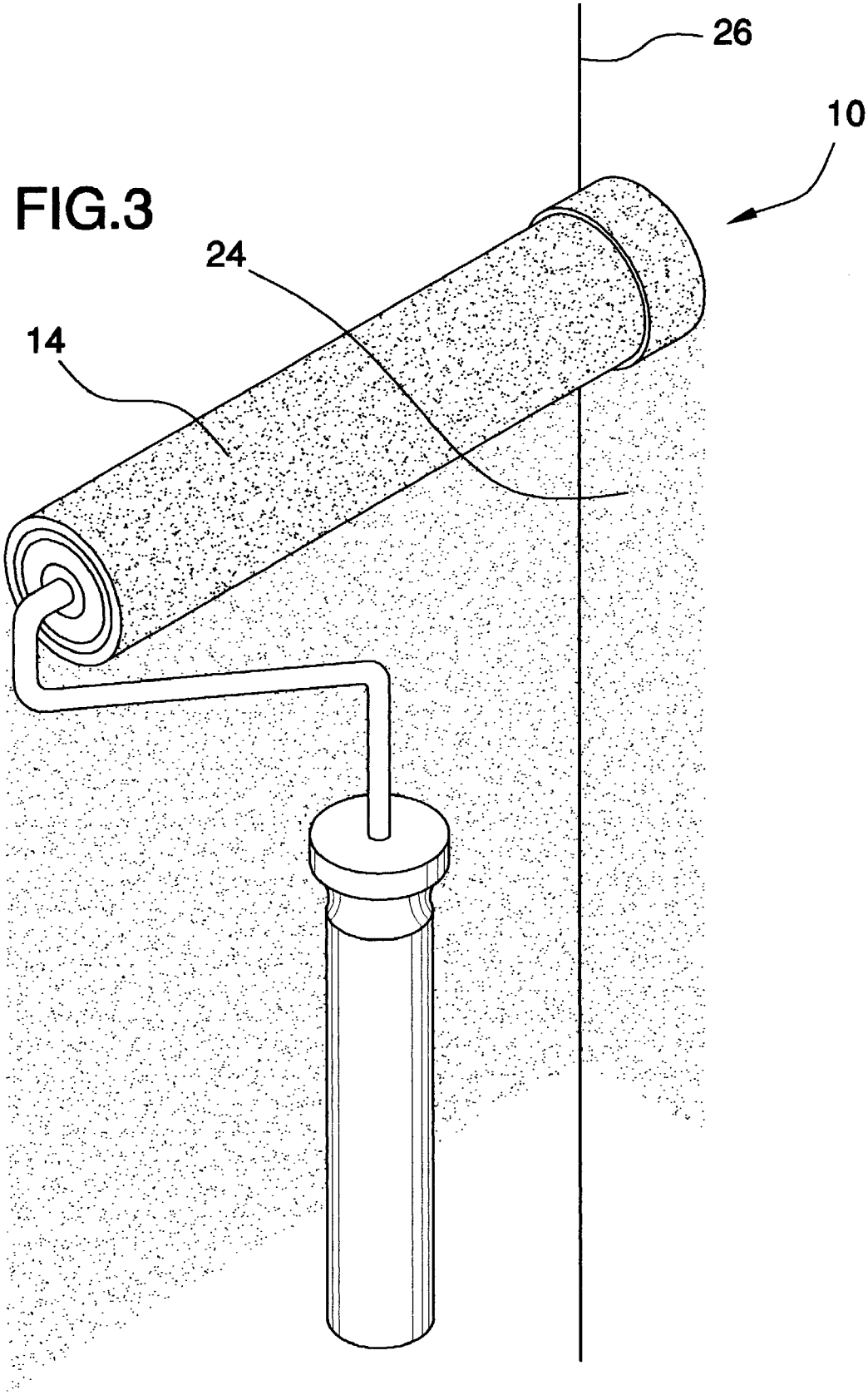
FIG. 3 is a front perspective view of the paint roller cover extender of the present invention in use on a wall corner.

FIG. 3 shows a front perspective view of the paint roller cover extender 10 as it would be used to paint the corner area of a room. The elastic band 22 would allow the extender 10 to seamlessly blend into the roller cover 14, simultaneously producing a uniform pattern on the wall 24 and on both sides of the corner 26.

Figure 4:
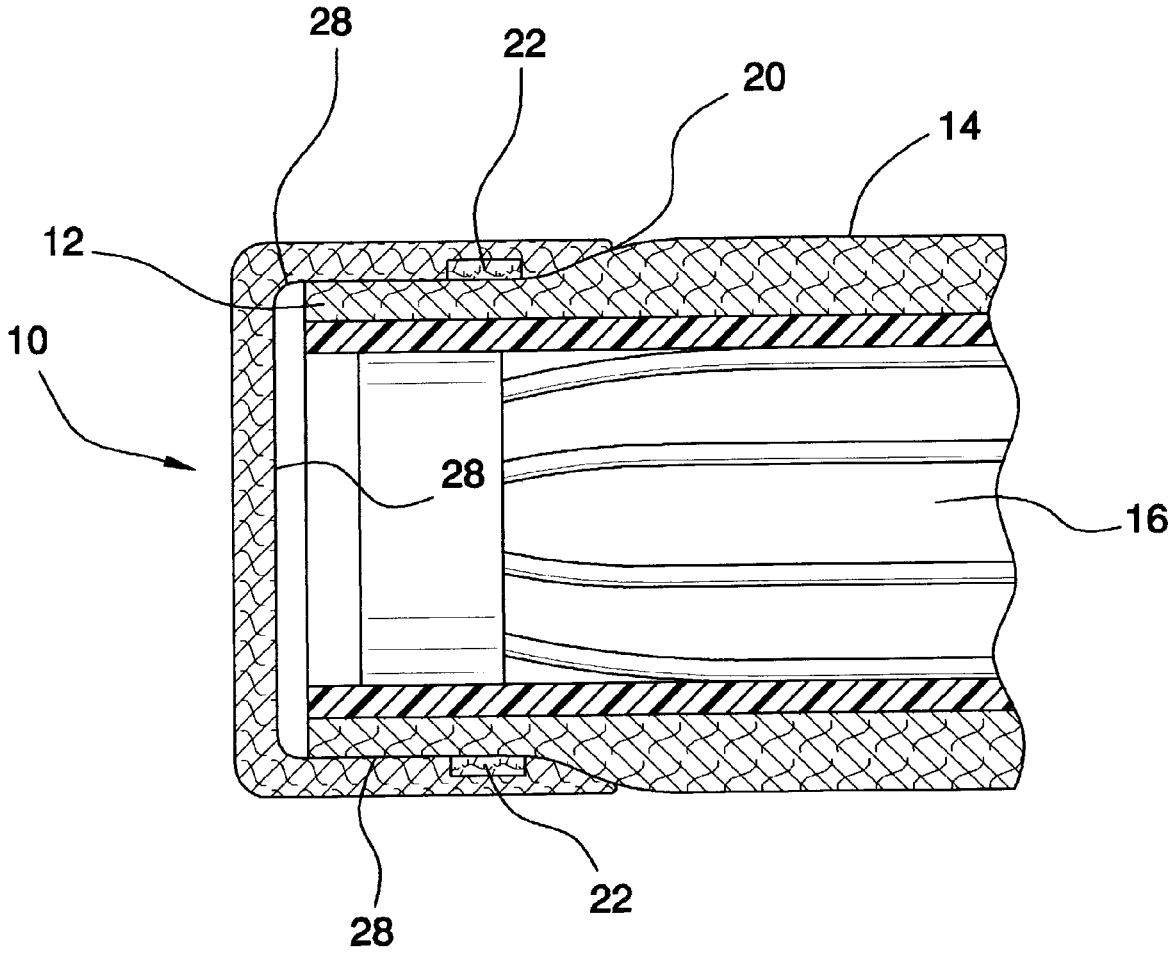
FIG. 4 is a front cross sectional view of the paint roller cover extender of the present invention taken along a longitudinal plane.

FIG. 4 shows a front cross sectional view of the paint roller cover extender 10 taken along a longitudinal plane. A standard roller cover 14 is mounted on a standard paint roller 16. The paint roller cover extender 10 is mounted on the distal end 12 of the roller cover 14. The elastic band 22 in incorporated into the inner surface 28 of the extender 10 near the edge of the open end 20. Since the roller cover 14 is made of an easily compressible material, the elastic band 22 compresses the material of the roller cover 14 when it is mounted, allowing the extender 10 to blend seamlessly with the roller cover 14.

In use, it can now be understood that the user would place a roller cover 14 on a paint roller 16. He would then stretch the elastic band 22 of the paint roller cover extender 10 and place it over the distal end 12 of the roller cover 14. The user would ensure that the extender 10 was securely mounted on the roller cover 14, and he would then place the roller in a paint reservoir. The roller would then be moved in an up and down motion to apply the paint to the desired surface. When the user arrived at a corner, he would make sure he applied paint to the extender 10 and continue his painting motion. The roller cover 14 would apply paint to one section of the corner 26, while the extender 10 would apply paint to the perpendicular surface of the corner 26.

While a preferred embodiment of the paint roller cover extender has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable soft, paint retentive material such as lamb's wool, synthetic lamb's wool, polyurethane foam, open celled foam, or a sponge type material may be used for the paint roller cover extender.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A paint roller assembly comprising, in combination:

a paint roller assembly having a handle, a roller having a first end and a second end wherein said first end of said roller is rotatably mounted on said handle, and a cylindrical roller cover having an inner surface, an outer surface, a first open end, and a second open end wherein said second end of said roller is inserted into said first open end of said roller cover and said roller cover entirely encompasses said roller;

a cylindrical cap having a sidewall forming an inner surface and an outer surface, a closed end, and an open end forming an outer edge and connected on said inner surface of said open end to said second open end of said roller cover wherein said sidewall of said cap overlaps said second end of said roller cover; and an elastic band connected to said inner surface of said cap near said outer edge.

2. The combination of claim 1 wherein the diameter of said cap is approximately equal to the diameter of said roller cover.

3. The combination of claim 1 wherein said closed end of said cap is made of the same material as the sidewall of said cap.

4. The combination of claim 3 wherein said cap is made of a paint retentive material.

5. The combination of claim 4 wherein said cap is comprised of lamb's wool.

6. The combination of claim 4 wherein said cap is comprised of synthetic lamb's wool.

7. The combination of claim 4 wherein said cap is comprised of a natural sponge type material.

8. The combination of claim 4 wherein said cap is comprised of a synthetic sponge type material.

9. The combination of claim 4 wherein said cap is comprised of foam.

* * * * *